US006367993B2

(12) United States Patent
Day et al.

(10) Patent No.: US 6,367,993 B2
(45) Date of Patent: Apr. 9, 2002

(54) PRINTER SYSTEM

(75) Inventors: Robert Charles Lewis Day, Nr. Royston; Lawrence Archard; Jonathan Kemp, both of Cambridge; Charles Robert Sims, Royston; Adrian Michael Woodward, Nr. Royston; Chris McCleve, London; Martin Gibbs, Udimore; Michel Woodman, Huntingdon, all of (GB); Geert Heyse, Sint Katelijne Waver (BE)

(73) Assignee: Esselte N.V., Sint-Niklaas (BE)

( * ) Notice: Subject to any disclaimer, the term of this patent is extended or adjusted under 35 U.S.C. 154(b) by 0 days.

(21) Appl. No.: 09/783,316

(22) Filed: Feb. 15, 2001

Related U.S. Application Data

(63) Continuation of application No. 09/438,544, filed on Nov. 12, 1999.

(30) Foreign Application Priority Data

Nov. 13, 1998 (GB) ..... 9825022

(51) Int. Cl.[7] ..... B41J 3/36; B41J 11/44
(52) U.S. Cl. ..... 400/88; 400/76; 400/61
(58) Field of Search ..... 400/88, 76, 70, 400/71, 61; 347/109

(56) References Cited

U.S. PATENT DOCUMENTS

| | | | | |
|---|---|---|---|---|
| 4,949,283 A | | 8/1990 | Yamauchi et al. | 364/519 |
| 5,063,451 A | | 11/1991 | Yanagisawa et al. | 546/143 |
| 5,126,955 A | | 6/1992 | Tomoda | 364/708 |
| 5,240,334 A | | 8/1993 | Epstein et al. | 400/88 |
| 5,308,173 A | | 5/1994 | Amano et al. | 400/29 |
| 5,634,730 A | | 6/1997 | Bobry | 400/88 |
| 5,684,931 A | * | 11/1997 | Hagar | 395/108 |
| 5,685,651 A | | 11/1997 | Hayman et al. | 400/88 |
| 5,816,718 A | * | 10/1998 | Poole | 400/88 |
| 5,825,995 A | | 10/1998 | Wiklof et al. | 395/117 |
| 5,927,872 A | * | 7/1999 | Yamada | 400/88 |
| 6,010,257 A | * | 1/2000 | Petteruti et al. | 400/88 |
| 6,062,686 A | * | 5/2000 | Kinoshita et al. | 347/109 |
| 6,092,941 A | | 7/2000 | Imai | 400/88 |
| 6,116,707 A | | 9/2000 | Amano et al. | 400/29 |
| 6,229,565 B1 | * | 5/2001 | Bobry | 348/207 |

FOREIGN PATENT DOCUMENTS

| | | |
|---|---|---|
| EP | 0 598 251 | 5/1994 |
| NL | 9 202 068 | 6/1994 |

OTHER PUBLICATIONS

IBM Technical Disclosure NN7407565, vol. 17, Issue 2, 1974, pp. 565–567.*

* cited by examiner

*Primary Examiner*—John S. Hilten
*Assistant Examiner*—Charles H. Nolan, Jr.
(74) *Attorney, Agent, or Firm*—Pennie & Edmonds LLP

(57) ABSTRACT

A portable printer is provided which provides active cooperation between a computer and the portable printer unit. A number of different features are introduced into the printing unit which allow greater responsiveness from the computer responsive to actions taken at the printer unit.

17 Claims, 4 Drawing Sheets

10
12
14
16
18
20
22
24
26
28
30
32
34
36

PRINTER SYSTEM

This application is a continuation of pending application Ser. No. 09/438,544, filed Nov. 12, 1999, the contents of which is incorporated herein in the entirety.

FIELD OF THE INVENTION

The present invention relates to a printing system and to a printer unit for use in such a system.

BACKGROUND TO THE INVENTION

In the state of the art, a number of printers arranged to be manually placed on an image receiving medium are known. The printing means of the printer or the entire printer is operable to scan over the image receiving medium in the printing operation. Thus, the medium is not fed through the printer—as in most office sheet printers, but the printer is placed upon the medium.

Such a printer is known from EP 564297-A. The printer has an ink jet print head which is scanning in two orthogonal directions over the image receiving medium, onto which the printer is placed manually. The printer is connected to a computer and capable e.g. of printing addresses onto envelopes, but can also be used separately from the computer for printing data downloaded from the computer to the printer.

Another ink jet printer to be placed on a printing medium is disclosed in U.S. Pat. No. 5,634,730 A. This printer is provided with a keyboard for data inputting, but can also print images downloaded from a computer. The print head scans over the image receiving medium along a special path, e.g. helically or like a pendulum. It can print data downloaded from a computer or one of a set of predetermined words such as "PAID" etc.

DE 3142937-A refers to a so-called hand stamp which is placed manually on the image receiving medium. It can print data downloaded from an accounting machine, or images consisting of user-selected fixed phrases. The hand stamp has a thermal print head and an ink ribbon for printing.

The printers known in the prior art are thus capable of printing an image onto an image receiving medium, and make use of a scanning print head. Printing is performed in two steps: the first one is alignment of the printer on the image receiving medium such that the image can be printed in the desired position and the second step is printing. However, although the printers can communicate with a computer to receive data to be printed, that is the limit of their interaction. There is no other active cooperation between the printer unit and a computer.

SUMMARY OF THE INVENTION

It is one aim of the present invention to provide a printing system in which there is more active cooperation between a computer and the printer unit.

According to one aspect of the invention there is provided a printing system comprising:

a printing unit;

a base station configured to receive the printing unit when not in use and having means for detecting movement of the printing unit from the base station;

a computer connected to the base station and configured to execute a printing application for generation of printing data for the printing unit, wherein said printing application is initiated by the computer when movement of the printing unit from the base station is detected.

Another aim of the invention is to provide a printer unit for use in a printing system which has a wider range of user interface functions.

According to another aspect of the invention there is provided a printing system comprising:

a printing unit; and a computer connectable to the printing device and configured to execute a printing application for generation of printing data for transmission to said printing device for printing;

wherein the printing system includes a memory which holds a plurality of default printing data options each having associated therewith a time activation period and means for determining the time at which the printing application is initiated, wherein the printing application includes a default output sequence for generating one of said default printing data options in accordance with the detected time of initiation of the printing application.

This allows a user profile to be recognized so that the printing system is responsive to a user's requirements. The memory may be in the computer or within the printing unit.

A further aspect of the present invention provides a printer adapted for communication with a host computer, the printer comprising:

communication means for receiving printing data to be printed from the host computer while a communication link exists between the printer and the host computer, said printing data defining a sequence of images to be printed;

a data path for conveying data received at the communication means to a printing mechanism for printing said data;

a user input means for instigating a print command; and a controller connected to the printing mechanism and operable to allow the printing mechanism to print successive images in the sequence, each successive image being printed responsive to the user instigated print command.

This feature can be used with the printer connected to the computer and for receiving successive images therefrom, or at a location remote from the host computer when the communication link is broken. In that case, the printer can have a store for holding the printing data.

In addition, this aspect of the invention provides a method of printing a series of images comprising:

establishing a communication link between a printer and a host computer;

transferring printing data defining said images from the host computer to the printer;

breaking the communication link and moving the printer unit to a location remote from the host computer; and at the remote location, printing successively each image in the sequence responsive to a user instigated print command at the printer unit at said remote location.

According to an alternative aspect of the present invention, there is provided a method of printing a series of images comprising:

establishing a communication link between a printer and a host computer, the printer including user input means for instigating a print command; and successively transferring printing data defining each image in the sequence from the host computer to the printer and printing said each image responsive to a user instigated print command.

Another aspect of the invention provides a printing system comprising:

a printing unit including user input means for instigating a print command;

a base station configured to receive the printing unit when not in use;

a computer connected to the base station and configured to execute a printing application for generation of printing data for the printing unit, the computer comprising a keyboard; and wherein execution of the printing application is interrupted by operation of any key on the keyboard of the computer or the user input means on the printing unit.

One key of the keyboard may be defined as a "hot key" which remains active as the application is running such that when the hot key is depressed, a particular function is initiated.

For a better understanding of the present invention and to show how the same may be carried into effect, reference will now be made to the accompanying drawings.

DESCRIPTION OF THE PREFERRED EMBODIMENT

Figure 1:
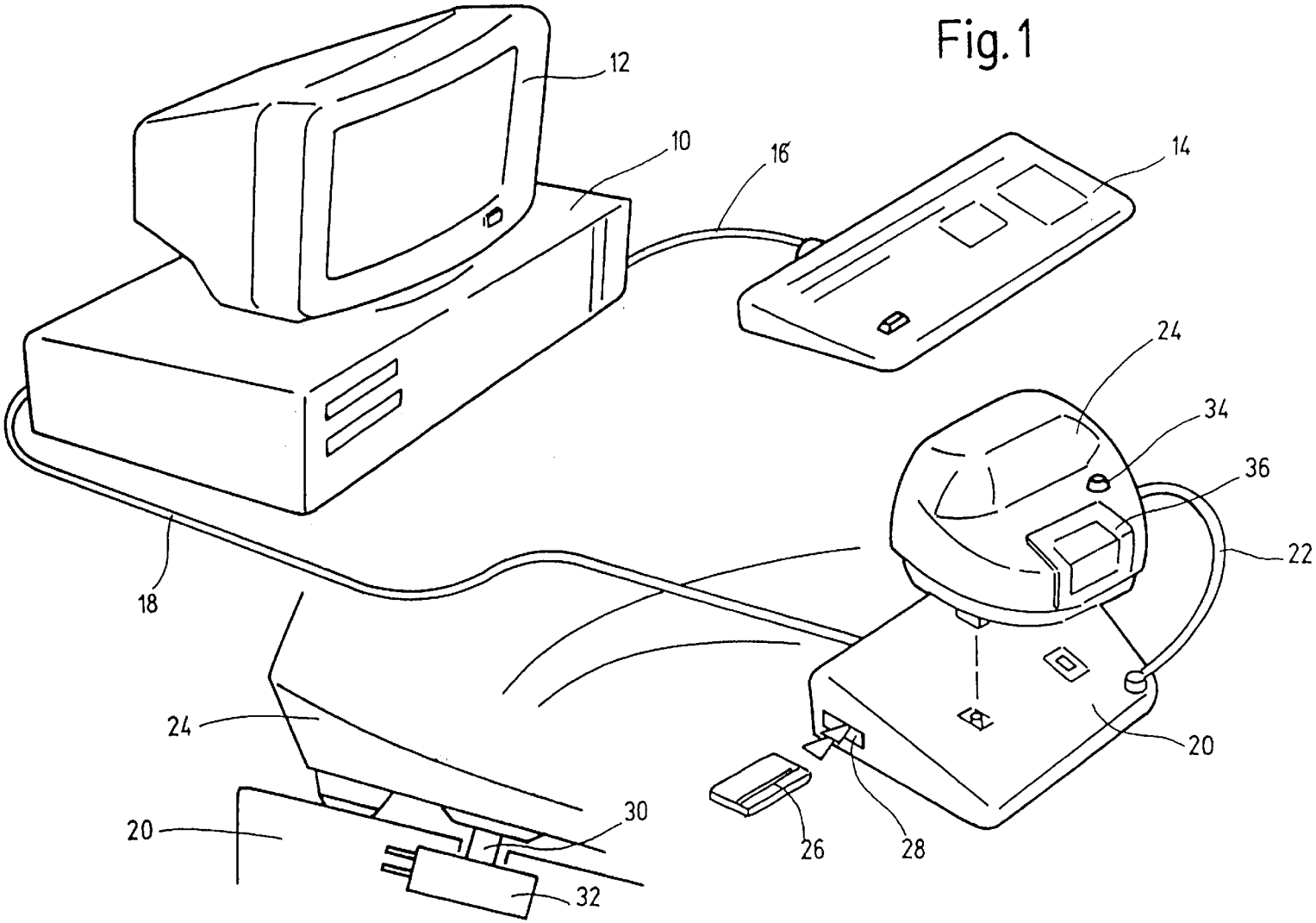
FIG. 1 is a plan view showing a printer, a base station and a computer.

FIG. 1 shows a printing system consisting of a computer 10, a computer controlled display 12, which is in the described embodiment of the invention a CRT, a keyboard 14 linked to the computer 10 by means of a cable 16, another cable 18, connecting the computer 10 with a base station 20, which is connected to a printer 24 by means of a cable 22. Thus, the printer 24 is linked to the computer via the cables 18,22 and the base station 20.

As known in the prior art, the computer 10 comprises a processor on which a software is running, comprising an operating system, a printer driver to enable printing with the printer 24 from the operating system and a software application by which data can be created, selected and formatted on the PC, for defining image patterns to be printed by the printer 24. The software application can be activated in a number of ways:

selected by the user at start-up or from the desktop: the user places the software application in the start-up directory or creates an icon on the desktop;

from within another application: the user invokes the software application from a button (displayed on the display 12) in the toolbar of another software application or from its own floating toolbar.

from the handheld printer 24 itself: if the application is not running, the user presses a print button 34 on the handheld printer 24, which will automatically invoke the software application in the first instance.

According to an embodiment of the invention, however, the software application is activated on the computer 10 for controlling the printer 24 by lifting the printer 24 off the base station 20. A switch 32 is provided in the base station 24 sensing the presence or absence of the printer 24 by means of a pin 30. When the printer 24 is placed upon the base station, the pin 30 is depressed, and the switch 32 is closed. In the case that the printer 24 is removed from the base station 20, the pin 30 which is biased in the vertical direction moves upwardly and the switch 32 opens. The switch is connected via some electronic circuits to the computer 18 and activates the software application for printing. Conversely, when the printer 24 is returned to the base station, the state of the switch is detected to automatically return the computer to the main application which it was executing when the printer was removed. This functionality is described in more detail later with reference to FIG. 4.

That is, a default printing application on the computer changes to the present printing application when it is "activated" by one of the techniques mentioned. When it is "deactivated", the default printing application is returned to an original printing application.

The base station 20 is connected to the computer 10 by means of the cable 18, which can be a parallel or a USB cable. Electric power is supplied to the base station 20 by a separate mains transformer, but could also be supplied from the computer via the cable 18, preferably when the cable 18 is a USB cable. The cable 18 can be hard-wired to the base station 20, or connected to a socket of the base station, which is preferably provided at the rear thereof. When the printer 24 is not in use, the handheld printer will be placed in the base station 20. The base station 20 will ensure that the ink jet print head of the printer 24 is protected when not in use by a capping device that will be automatically triggered whenever the printer is inserted into the base station 20. The base station 20 will also cause the print head of the printer 24 to eject ink into a reservoir and mechanically clean the surface of the print head. These measures are necessary to maintain optimum print quality.

The umbilical cable 22 connects the base station 20 to the hand held printer 24, providing both power and data. A LED on the printer will indicate that power is on. The printer 24 is removed from the base station 24 and positioned on the surface to be printed. The length of the cable 22 limits the distance of travel from the base station.

In another embodiment of the invention, the printer is arranged to be disconnected from the base station by unplugging the umbilical cable 22 and moved to another location wherein printing of the contents of on-board memory, i.e. downloaded image data, can be effected. The user will employ scroll buttons on the printer to select the required print data, which appear in a small LCD. Once a selection has been made, pressing the print button 34 will activate printing. Having selected the data to print using the software application (or the scroll buttons on the printer), the user will activate printing from the print button 34 on the hand held printer 24 itself.

According to a further alternative, data for printing can be sent to the printer using RF or IR technology. The scroll buttons may be used to select data which may be stored on the "smart card" or which resides in the computer.

Print alignment is achieved visually through a transparent window 36 in the print casing. This window 36 can also be opened for inserting an ink cartridge into the printer 24 before use. The cartridge is then clamped in a carriage of the printer 24. The window 36 must be closed before printing; thus there is a switch provided in the housing of the printer for detecting whether the window is closed or not. When the window 36 is not closed, the switch disables printing. Changing a cartridge is achieved by lifting a retaining lever and extracting the cartridge in use and replacing this with a new or different color cartridge in the way described above. If the removed cartridge still contains ink and is to be reused it must be capped to avoid the ink drying out.

Alternatively a Think jet type head from Hewlett Packard may be used which utilizes a different type of ink which does not dry out in the print head.

The printer 24 contains a print mechanism with the ink jet print head having a number of print nozzles, and an ink supply. The print head is moved by means of motor driven scanning means within the housing in two (generally orthogonal) directions such that a rectangular area can be imprinted through an aperture of the printer 24 at the bottom of its housing. Thus, the printer 24 is placed manually on an image receiving medium and—when the print button 34 is depressed—the print head scans over the medium and imprints it by spitting ink droplets onto it.

FIG. 1 shows the presence of a "Smart Card" reader 28 in the base station 20. Smart cards 26, i.e. memory cards, may be used for storing data or images or as a substitute for additional RAM in the base station.

In another embodiment, a printer is provided which can only be used as a stand-alone device, i.e. in cooperation with a base station. The functionality of the printer is then as follows: the user removes the printer from the base station. A single button 36 (see FIG. 2) will switch the printer on and off, and a LED on the printer will indicate that power is on. A ROM card containing the selected image data is inserted into the printer. The ROM card is printed with images of its content and the sequence of images provided on the ROM card is indicated numerically on a display of the printer. Thus, the user will select the desired image using scroll buttons to scroll forward or backwards through the numbered content. The user will activate printing from the button 36 on the handheld printer itself.

Figure 2:
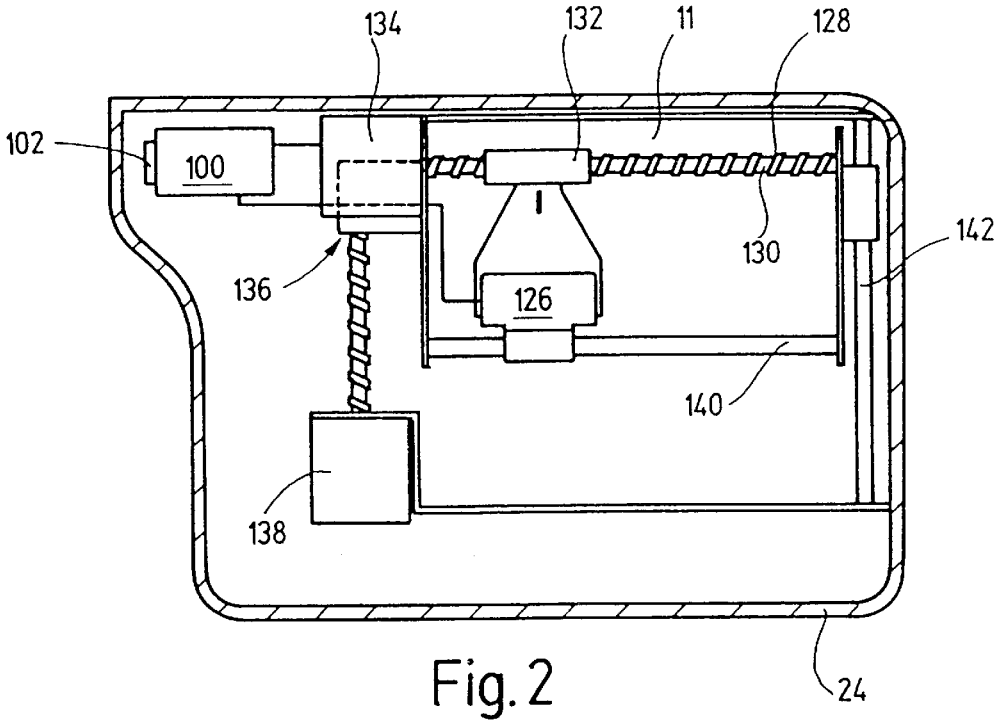
FIG. 2 is a view of the printing mechanism of the printer.

The print mechanism of the printer will now be described with reference to FIG. 2. The printer 24 has a housing, the underside of which can be abutted against the surface of the image receiving medium to be printed. A print face 11 is defined by the scanning range of an ink jet print head cartridge 126 which can be replaced using the cartridge release mechanism described above. The ink jet print head cartridge 126 is mounted for movement along a write axis 128 by virtue of a cooperating lead screw 130 and nut 132. The movement is controlled by a stepper motor 134. The position of the writing axis 128 can be altered by an indexing axis lead screw and bush 136 controlled by a further stepper motor 138. Reference numeral 140 designates a stability bar which extends parallel to the write axis 128, the ink jet print head cartridge 126 being mounted between the write axis 128 and the stability bar 140. Reference numeral 142 designates an indexing axis stability bar and bush.

The printer also includes an electronic controller 100 having a microprocessor for controlling movement of the stepper motor 34 and generating signals for controlling the print head and having a buffer memory for storing data. The microprocessor is capable of converting data from a computer to which the device is connected into a format suitable for driving the print head. The buffer memory can store information in a variety of formats to enable the printer to work with a variety of computer equipment.

If a Think jet print head is used, a DC motor and encoder may be used in place of a stepper motor.

Figure 3:
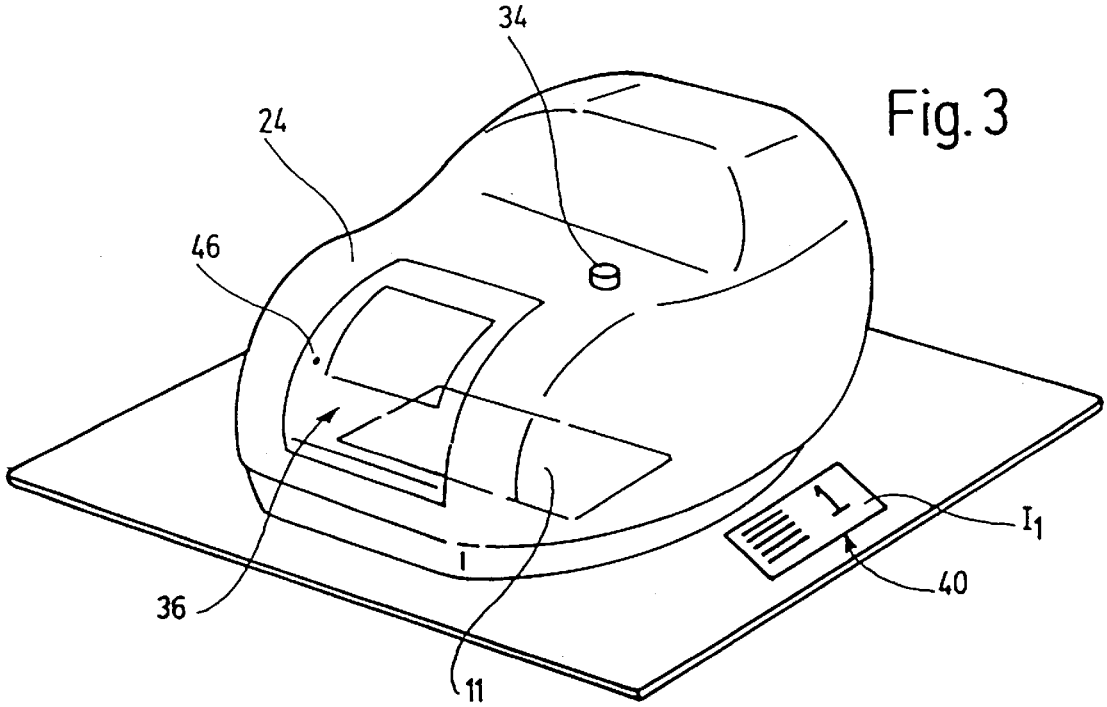
FIG. 3 is a view of a printer in use.

In FIG. 3, a printer 24 positioned on an image receiving medium 40 is shown ready for use. That is, it has been removed from the base station 20 and placed on the medium 40 to be printed. In doing so, the application software is automatically initiated to allow printing data to be selected and configured by a user using the computer 12 and keyboard 14.

Figure 4:
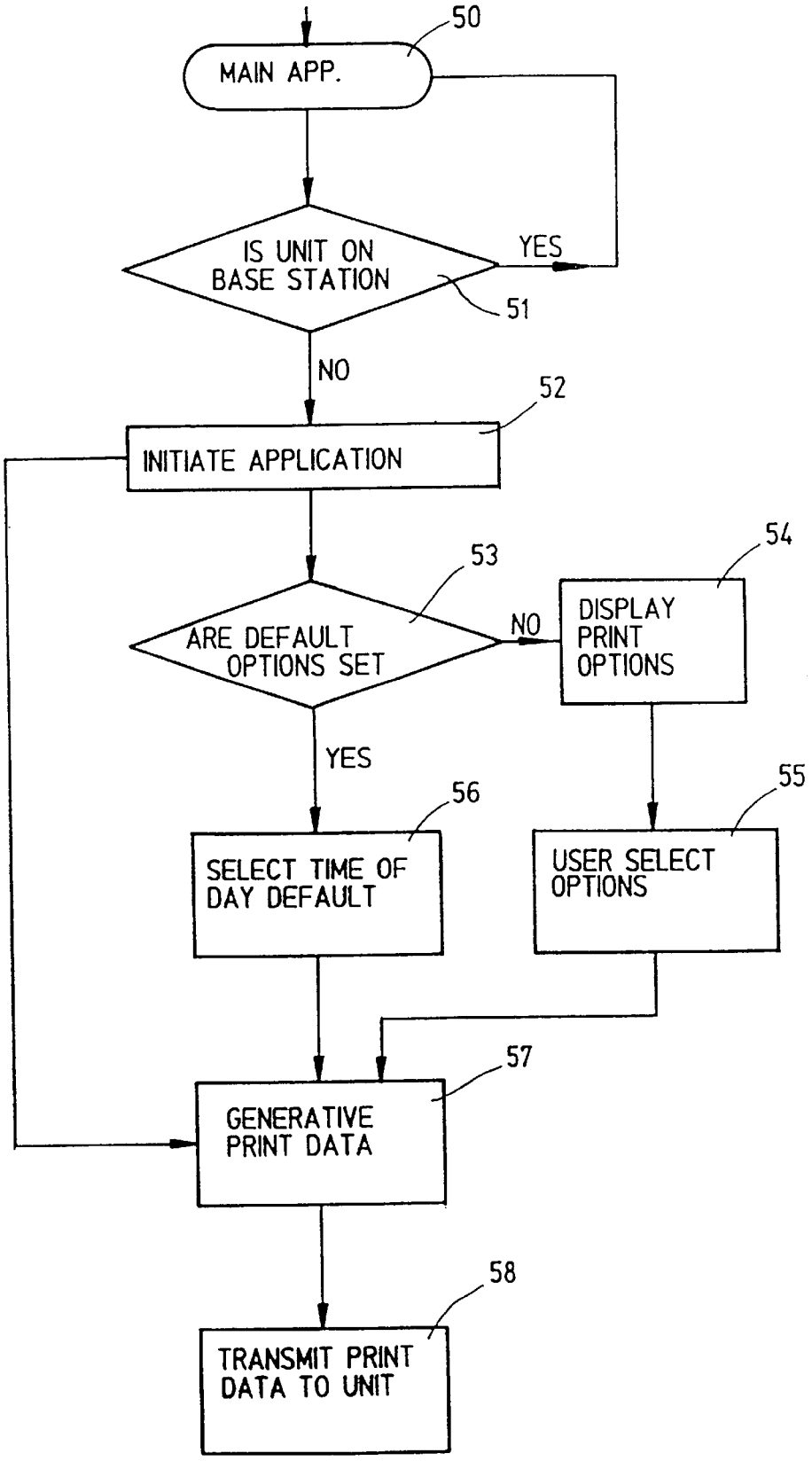
FIG. 4 is a flow diagram of the software printing application.

Some aspects of the application software will now be described with reference to FIGS. 4 to 6. In addition to the automatic initiation of the application, the application allows for a number of default print options depending on a user profile as will now be described. FIG. 4 is a flow chart of the printing application. Assume the computer is executing a main application (step SO) and the printer 24 stands ready for use on the base station 20. At step S1, the state of the switch is monitored by the application software to determine whether or not the printer unit 24 is on the base station 20. When the printer unit 24 is removed from the base station 20, at step S2 the printing application is initiated by the computer. At step S3, the printing application determines whether or not default options are set. If no default options are set, a number of print options are displayed on the PC display at step S4 from which a user may select his required option at step S5. Alternatively, a user may simply use the printing application initiated at step S2 to create, select and format printing data using the keyboard 14 and the display 12 as with any existing printing application. However, the provision of default options simplifies use of the printing system for a user, in particular a user who has predictable requirements.

If default options are found to be set at step S3, the application software selects one of the default options based on the time of use, as indicated at step S6. This is described in more detail later. At step S7, print data is generated in accordance either with the user selected option at step S5 or the default option selected by the application software at S6. Then, at step S8 the printing data is transmitted to the printer 24 ready for printing.

Step S1 is periodically implemented to check the status of the printer 24. If it is determined to have been returned to the base station, the computer automatically returns to the main application, step S0.

Figure 5:
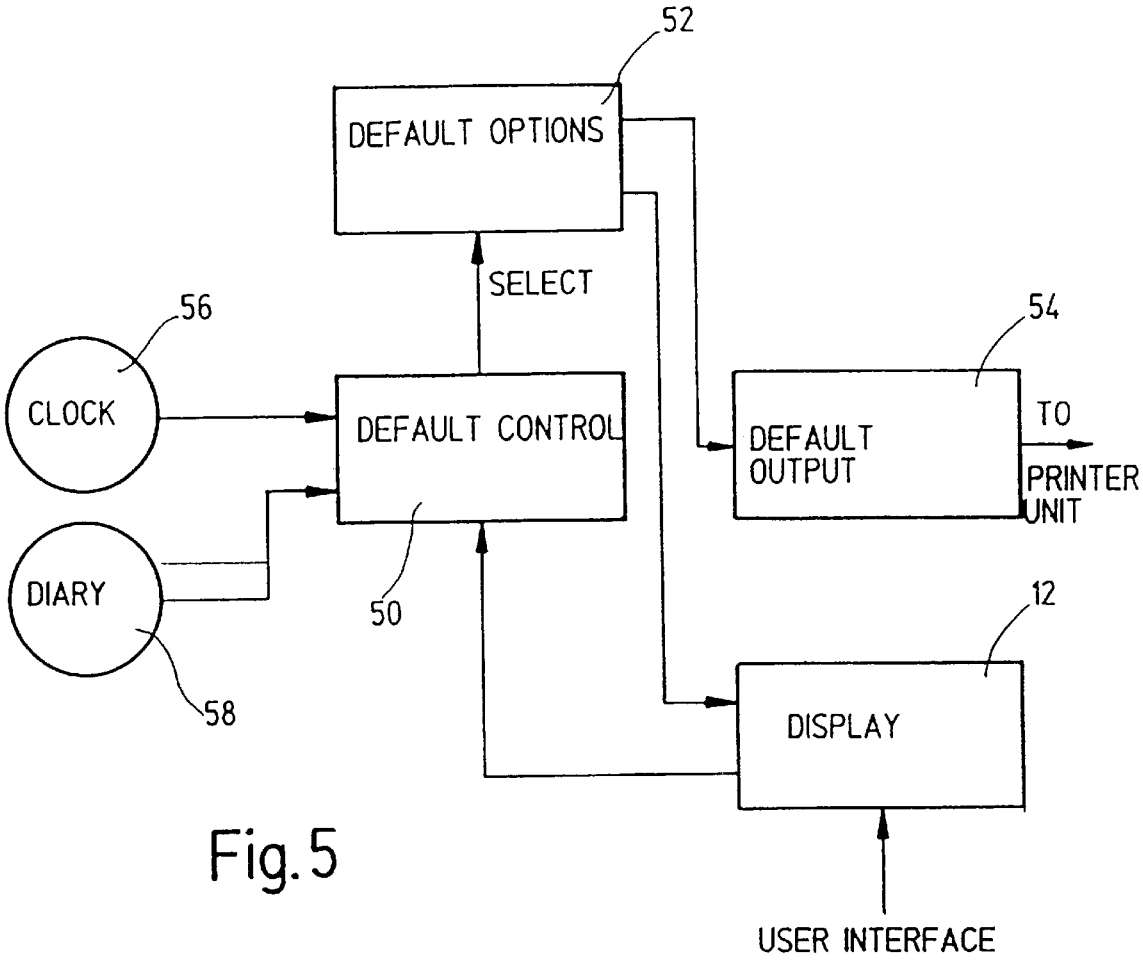
FIG. 5 is a block diagram illustrating time related activation default options.
Figure 6:
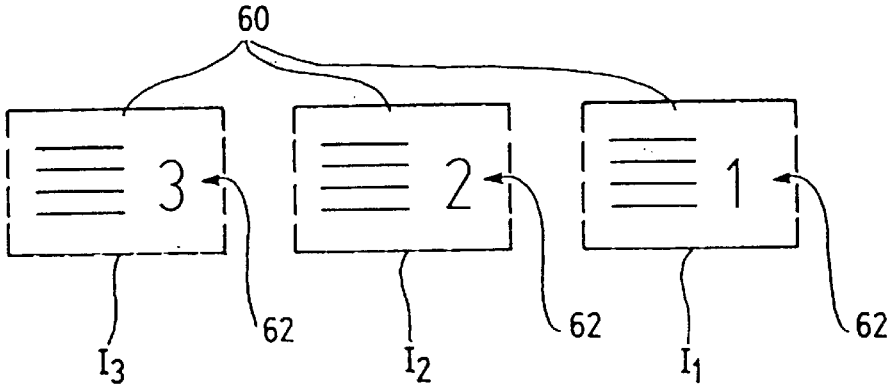
FIG. 6 illustrates a sequence of images to be printed.

FIG. 5 is a block diagram illustrating elements of the system to implement default options with time related activation periods. A default control block 50 selects from a plurality of default options held in a memory 52. The selected option is used by a default output sequence 54 to generate default printing data for the printer unit 24. Default control block 50 can be responsive to an internal clock 56 or diary function 58 of the computer system so that a default options is selected in accordance with the time of day or day of the week. Alternatively, the default options may be supplied to the display 12 where a user selects a particular option, for example using user activated icons.

For example, for options with a time related activation period, a user could set the default output to be "RECEIVED" when the internal clock 56 of the computer indicates the time between 9 am and 11 am, and from 11.01 am and 5.30 pm the default output could be an address format.

During printing, the system may be interrupted at any stage by pressing any key on the keyboard 14 or any button on the printer unit 24 itself, in particular the print command button 34.

One of the advantages of the system described herein is that the printer unit may be used at locations remote from the computer. In particular, this is the case where the cable 22 which normally connected the printer unit 24 to the base station 20 can be detached. It may be the case that it is desired to print sequential information at a number of different remote locations, for example so as to print on a number of different products. FIG. 6 illustrates a sequence of images denoted I1, I2, I3 each of which carry a common part 60 of information and a sequentially varying part 62, that is the numbers 1, 2, 3. The system described herein allows the whole sequence of images to be transmitted to the printer unit during operation of the application software (step S8 in FIG. 4). Subsequently, each image in the sequence can be individually printed responsive to operation of the print command button 34 on the printer unit 24. After an image in the sequence has been printed, the controller in the printer automatically selects the next image for printing on the next print command. This technique is useful for example in printing sequential numbers as illustrated in FIG. 6, barcodes or a sequence of database information.

FIG. 3 illustrates the printer in use to print a sequence of images. The first image, 11, has been printed by the printer 24. The printer 24 has been lifted up and relocated in a different position. On actuation of the print command button 34, the next image, 12, in the sequence will be printed at the new printer location.

What is claimed is:

1. A printer adapted for communication with a host computer, the printer comprising:

communication means for receiving printing data to be printed from the host computer while a communication link exists between the printer and the host computer, said printing data defining a sequence containing a plurality of images to be printed;

a data path for conveying data received at the communication means to storage means for holding said data;

a printing mechanism for printing said data, the printing mechanism having a housing defining a print location;

a user input means for instigating a print command; and a controller connected to the storage means and to the printing mechanism, said controller adapted to allow the printing mechanism to print the plurality of successive images in the sequence at a plurality of respective print locations remote from the host computer with the communication link broken, each successive image being printed responsive to a user instigated print command.

2. The printer of claim 1, further comprising:

a display on the printer for displaying a version of the image to be printed; and at least one scroll button on the printer for scrolling through the plurality of stored images, wherein the image printed responsive to a user instigated print command is the image represented in the display.

3. A printing system comprising:

a printing unit; and a computer connectable to the printing unit and configured to execute a printing application for generation of printing data for transmission to said printing unit for printing, wherein the printing system includes:

a memory which holds a plurality of default printing data options each having associated therewith a time activation period, and means within the printing system for determining the time at which the printing application is initiated, and wherein the printing application includes a default output sequence for generating one of said default printing data options in accordance with the detected time of initiation of the printing application.

4. The printing system of claim 3 wherein the printing unit comprises a portable housing defining a print face and a print head which is movably mounted along both a write axis and an indexing axis within the portable housing, the print head being selectively operable at a plurality of locations within the print face to print images.

5. The printing system of claim 3 wherein the means within the printing system for determining the time is located within the computer.

6. A method of printing a series of images comprising:

establishing a communication link between a printer and a host computer;

transferring printing data defining a plurality of said images from the host computer to the printer;

breaking the communication link and moving the printer unit to a first location removed from the host computer, at the first remote location, printing a first image in the sequence responsive to a user instigated print command at the printer unit;

moving the printer to a second remote location; and at the second remote location, printing a second image in the sequence responsive to the user instigated print command.

7. The method of claim 6 wherein the printer comprises a portable housing defining a print face and a print head which is movably mounted along both a write axis and an indexing axis within the portable housing, the print head being selectively operable at a plurality of locations within the print face to print images.

8. The method of claim 6 further comprising:

at a remote location, displaying a display version of the image to be printed on a display integral to the printer;

activating at least one scroll button for scrolling through the plurality of stored images, thereby scrolling through the plurality of images, wherein the image printed at that remote location, responsive to the user instigated print command, is the image represented in the display.

9. A method of printing a series of images comprising:

establishing a communication link between a printer and a host computer, the printer including user input means for instigating a print command and having a housing defining a print location; and successively transferring printing data defining each image in the sequence from the host computer to the printer;

eliminating the communication link between the printer and the host computer; and, responsive to a user instigated print command at each print location, printing said each image within the housing and at a respective print location.

10. The printing system of claim 3 wherein execution of the printing application is interruptible by operation of a key on the keyboard of the computer.

11. The printing system of claim 10 wherein execution of the printing application is interruptible by operation of any key on the keyboard of the computer.

12. The printing system of claim 10 wherein execution of the printing application can also be interruptible by operation of the user input means on the printing unit.

13. The printing unit of claim 1 wherein the printing mechanism comprises a print head adapted to apply an image within a portion of the print location, and further comprises a portable housing defining a print face and a print head which is movably mounted along both a write axis and an indexing axis within the portable housing, the print head being selectively operable at a plurality of locations within the print face to print images.

14. The printing unit of claim 2 wherein the printing mechanism comprises a print head adapted to apply an image within a portion of the print location, and further comprises a portable housing defining a print face and a print head which is movably mounted along both a write axis and an indexing axis within the portable housing, the print head being selectively operable at a plurality of locations within the print face to print images.

15. The method of claim 8 wherein the printer comprises a portable housing defining a print face and a print head which is movably mounted along both a write axis and an indexing axis within the portable housing, the print head being selectively operable at a plurality of locations within the print face to print images.

16. The method of claim 9 wherein the printer comprises a portable housing defining a print face and a print head which is movably mounted along both a write axis and an indexing axis within the portable housing, the print head being selectively operable at a plurality of locations within the print face to print images.

17. The printing unit of claim 10 wherein the printing unit comprises a printing mechanism including a print head adapted to apply an image within a portion of the print location, and a portable housing defining a print face and a print head which is movably mounted along both a write axis and an indexing axis within the portable housing, the print head being selectively operable at a plurality of locations within the print face to print images.

* * * * *